US007685758B2

(12) United States Patent
Romer

(10) Patent No.: US 7,685,758 B2
(45) Date of Patent: Mar. 30, 2010

(54) ACCESSORY RAILS FOR FIREARMS AND METHODS OF OPERATING THE SAME

(75) Inventor: Thomas Romer, Wohnsitz (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 139 days.

(21) Appl. No.: 11/506,305

(22) Filed: Aug. 18, 2006

(65) Prior Publication Data

US 2010/0037505 A1 Feb. 18, 2010

Related U.S. Application Data

(63) Continuation of application No. PCT/EP2005/001654, filed on Feb. 17, 2005.

(30) Foreign Application Priority Data

Feb. 18, 2004 (DE) ..... 10 2004 007 916

(51) Int. Cl.
*F41G 1/38* (2006.01)
*F41G 1/033* (2006.01)
*F41G 1/17* (2006.01)

(52) U.S. Cl. ..... 42/124; 42/85

(58) Field of Classification Search ..... 42/85
See application file for complete search history.

(56) References Cited

U.S. PATENT DOCUMENTS

| | | | | | |
|---|---|---|---|---|---|
| 1,636,509 | A | * | 7/1927 | Hatcher | 42/137 |
| 1,750,676 | A | * | 3/1930 | Lyman, Jr. | 42/137 |
| 1,834,637 | A | * | 12/1931 | Pedersen | 42/137 |
| 1,908,019 | A | * | 5/1933 | Howard | 42/139 |
| 1,929,418 | A | * | 10/1933 | Garand | 42/137 |
| 2,108,150 | A | * | 2/1938 | Swebilius | 42/137 |
| 2,331,903 | A | * | 10/1943 | Garand | 42/140 |
| 2,438,601 | A | * | 3/1948 | Davis | 42/137 |
| 2,484,368 | A | * | 10/1949 | Young | 42/138 |
| 2,593,870 | A | * | 4/1952 | Ganzhorn | 42/135 |
| 2,774,143 | A | * | 12/1956 | Sunderland | 42/137 |
| 3,495,339 | A | * | 2/1970 | Elliason | 42/137 |
| 3,662,469 | A | * | 5/1972 | Charron | 42/137 |
| 3,824,697 | A | * | 7/1974 | Into | 42/139 |
| 4,597,211 | A | * | 7/1986 | Miles | 42/112 |

(Continued)

FOREIGN PATENT DOCUMENTS

| | | |
|---|---|---|
| DE | 199 05 405 | 12/2000 |

OTHER PUBLICATIONS

*International Search Report* for international patent application serial No. PCT/EP2005/001654.

(Continued)

*Primary Examiner*—Troy Chambers
(74) *Attorney, Agent, or Firm*—Hanley, Flight & Zimmerman, LLC

(57) ABSTRACT

Accessory rails for use with firearms are disclosed. An example rail includes a front sight arrangement that has a width less than the width of the rail, wherein the front sight arrangement is retractable and wherein the front sight arrangement is laterally adjustable. The example rail also includes a rear sight arrangement that has a width less than the width of the rail, wherein the rear sight arrangement is retractable and wherein the rear sight arrangement is laterally adjustable.

19 Claims, 4 Drawing Sheets

U.S. PATENT DOCUMENTS

| | | | | |
|---|---|---|---|---|
| 4,606,131 | A * | 8/1986 | Domian | 42/137 |
| 4,648,191 | A * | 3/1987 | Goff et al. | 42/75.02 |
| 5,142,806 | A | 9/1992 | Swan | |
| 5,343,650 | A * | 9/1994 | Swan | 42/117 |
| 5,426,882 | A * | 6/1995 | Dornaus | 42/137 |
| 5,533,292 | A * | 7/1996 | Swan | 42/123 |
| 5,590,484 | A * | 1/1997 | Mooney et al. | 42/111 |
| 5,826,363 | A * | 10/1998 | Olson | 42/75.01 |
| 6,233,836 | B1 * | 5/2001 | Uhlmann et al. | 42/145 |
| 6,336,285 | B1 * | 1/2002 | Baumer | 42/124 |
| 6,490,822 | B1 | 12/2002 | Swan | |
| 6,499,245 | B1 | 12/2002 | Swan | |
| 6,508,027 | B1 * | 1/2003 | Kim | 42/124 |
| 6,618,976 | B1 | 9/2003 | Swan | |
| 6,622,415 | B1 * | 9/2003 | Canaday et al. | 42/140 |
| 6,779,290 | B1 * | 8/2004 | Houtsma | 42/148 |
| 6,895,708 | B2 * | 5/2005 | Kim et al. | 42/72 |
| 6,968,643 | B2 * | 11/2005 | Woodbury | 42/137 |
| 7,131,228 | B2 * | 11/2006 | Hochstrate et al. | 42/75.01 |
| 7,356,962 | B2 * | 4/2008 | Swan | 42/147 |
| 2003/0106252 | A1 | 6/2003 | Hines | |
| 2003/0127085 | A1 | 7/2003 | Brunette et al. | |
| 2003/0140546 | A1 * | 7/2003 | Kay | 42/133 |
| 2004/0226213 | A1 * | 11/2004 | Woodbury | 42/140 |

OTHER PUBLICATIONS

English translation of the *Written Opinion of the International Preliminary Examination Report* for international patent application serial No. PCT/EP2005/001654.

* cited by examiner

ACCESSORY RAILS FOR FIREARMS AND METHODS OF OPERATING THE SAME

RELATED APPLICATION

This patent is a continuation of International Patent Application Serial No. PCT/EP2005/001654, filed Feb. 17, 2005, which is hereby incorporated herein by reference in its entirety.

FIELD OF DISCLOSURE

This disclosure relates generally to firearms, and, more particularly, to devices for mounting accessories to firearms and methods of operating the same.

BACKGROUND

Firearm accessories are typically mounted to rails, sometimes known as sliding rails, prismatic rails, or accessory rails, which are coupled to the top or side profiles of the firearm. Some conventional rails include both rear and front sights and, for some, either or both of the rear sight and the front sight are retractable. See, for example, U.S. Patent Publication No. 2003/0127085; U.S. Pat. Nos. 5,142,806; 5,590,484; and 6,499,245; and German Patent No. DE 199 05 405.

Retractable rear sights are particularly known in the field of hunting in drop barrel weapons, particular three-barreled guns, which are usually manufactured via an expensive manual labor process. Typically, these foldable rear sights retract automatically when the weapon is set for firing rounds of buckshot to create a continuous surface with the sliding rail and then unfold again automatically when switching to rounds of bullets to provide sighting abilities. In addition, weapons shooting rounds of buckshot often also have a hinged, rough shotgun sight covering its rigidly mounted rifle sight. However, a front sight remains visible under all circumstances and protrudes over the front end of the sliding rail. Consequently, the sliding rail, which is constructed as a straight sliding rail or as a hollow rail, may primarily facilitate the aiming of the weapon when either fleeting rounds of bullets or rounds of buckshot are used. However, though movable in a retractable manner, these sights, once in the unfolded position, may not be properly aligned with and for the marksman.

Other weapons, such as machine-produced modern automatic pistols, usually include a carrying strap mounted on the top side of the weapon, which provides a top layer of protection or cover for the operating elements of the weapon. The carrying strap also forms a carrying handle in which an optical or mechanical sight is embedded or to which such a sight is mounted. Because the axis of the bore (i.e., center axis of the barrel) generally runs through the base plate of the shoulder support to minimize recoil action, the sight of the weapon must be attached at a considerable distance above the barrel so that the marksman occupies a natural position when firing the weapon. That is, the sight, which is the standard sight of the weapon, may be embedded in the carrying handle and may project far enough above the barrel of the weapon so that the line of sight is at an ideal distance above the weapon. Consequently, the additional mounting of a special aiming device (e.g., a sniper scope, telescopic sight, laser sight etc.) to the weapon, often results in an inaccurate location of the sighting line because the standard sight already occupies the ideal location.

Because the carrying straps of most automatic firearms, such as pistols, are removable, it would be possible to replace the carrying strap with a special aiming device. However, this would then omit the standard sight, which is disadvantageous because the special aiming device usually cannot be used as universally as the standard sight. In addition, though additional prismatic rails to which the special aiming devices are mounted, may be removed with repeating weapons, pistols, machine guns, automatic pistols, etc., other devices (e.g., search lights) can be detachably mounted in such a way that they do not block the line of sight.

In the case of weapons for snipers, guns and hunting rifles it is customary either to leave the standard sight off in the first place or to cover it up with the telescopic sight so that the standard sight can only be used when the telescopic sight has been taken off. In addition, there are telescopic sight assemblies for hunting weapons under which one can see through the standard sight; however, as indicated above with automatic pistols, this results in non-ideally positioned sights, i.e., the two lines of sight lie on top of one another so that, at best, only one can be optimal.

A hunting rifle with a narrow prism rail for holding the telescopic sight must be tested again each time the telescopic sight is taken off and put back on. In the case of wider sight rails this is not necessary, in particular in the case of the so-called "Picatinny rail." Thus, in this case, it is expedient to remove the special aiming device, in particular in military action, each time (e.g., after the action when the special sighting device is not required) to protect the weapon and/or the special sighting device from damage. This means that a standard weapon is generally equipped with its standard sight so that the weapon may be aimed even after the removal of the special aiming device.

However, when conditions such as, for example, environmental conditions change, it may be practical to remove an accessory like the special aiming device whenever it has become impractical (e.g., a night sight during the daytime). Then it is necessary that the standard sight is tested (i.e., adjusted) and that its line of sight is at the correct height, if possible. This is also true for other types of weapons and other types of accessories. For example, a laser sight used with a pistol may be practical during twilight but senseless if, for example, the batteries are dead or the weapon is being used on a sunny day in the open. However, though the inclusion of retractable sights greater decreases the need for gross realignment of the site while accessories are either mounted or removed, the retractable sights, once in the unfolded position, may, nonetheless be misaligned with and for the marksman.

DETAILED DESCRIPTION

In general, the illustrated example shows a firearm with a sliding rail, i.e., accessory rail mounted on its top side, at whose rear end a sight arrangement is mounted that can be lowered into the accessory rail and at whose front end a front sight arrangement is mounted. In addition, the illustrated example may comprise a kit that includes an automatic pistol with a removable carrying strap. Also, the illustrated example may also include an accessory rail that can be built onto the weapon in place of the carrying strap. Finally, the illustrated example firearm may be any type of firearm such as, for example, a rifle, a handgun, a pistol, a machine gun, a shotgun, etc.

Throughout this description, position designations such as "above," "below," "top'" "forward," "rear," "front," "back," etc. are referenced to a firearm held in a normal firing position (i.e., pointed away from the shooter in a generally horizontal direction toward a target). Furthermore, the normal firing position of the weapon is always assumed, i.e., the position in which the barrel runs along a horizontal axis and the elevation of the mounting device lies in a vertical plane that contains the barrel axis (for simplicity's sake lateral deviations on the basis of the projectile twist are not taken into consideration here).

Figure 1:
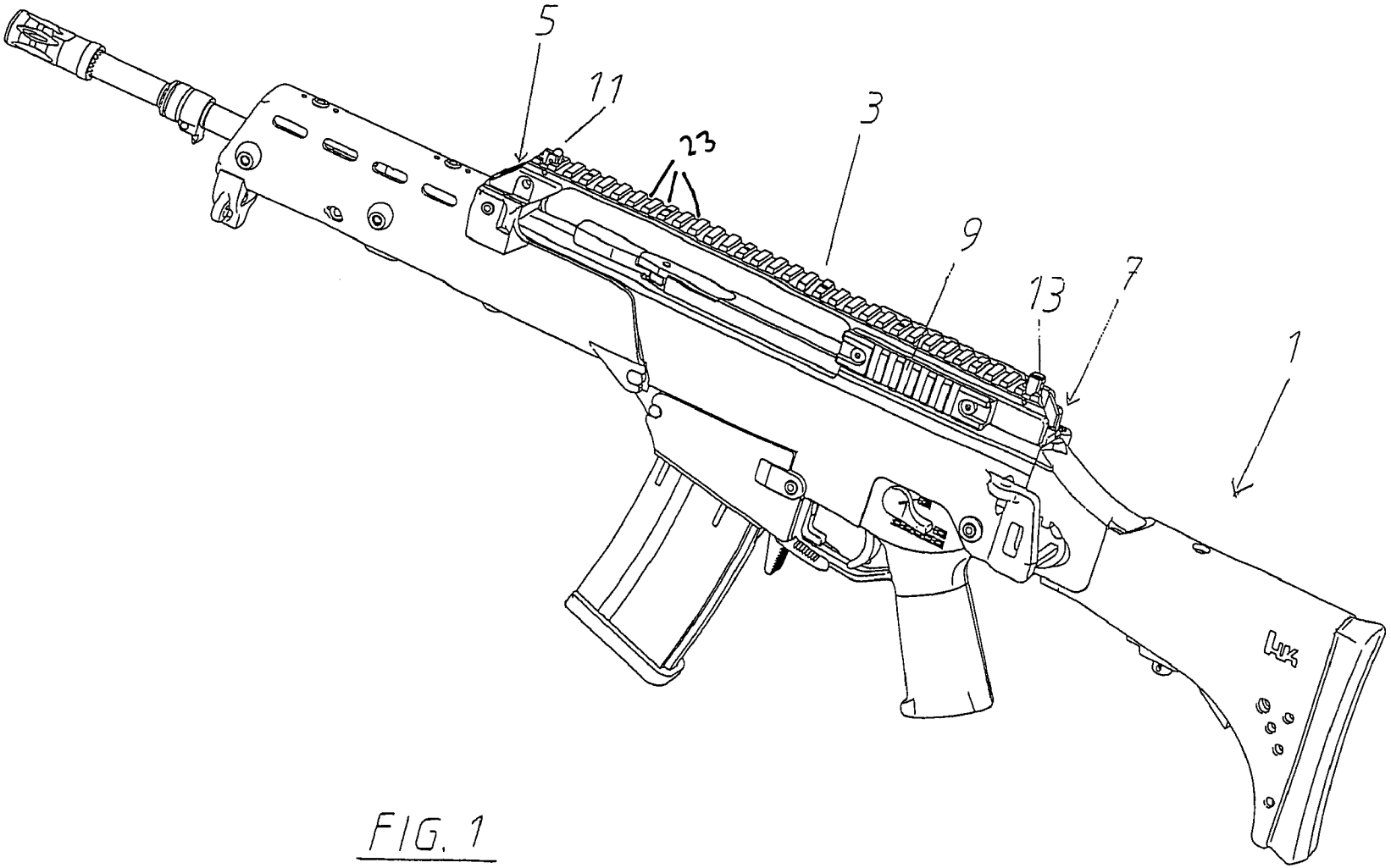
FIG. 1 is an oblique view of an example weapon with an example accessory rail.

In FIG. 1 an automatic firearm 1 is shown whose carrying handle (not shown) has been replaced by an accessory rail 3, which is at a distance above the axis of the bore (not shown) and is arranged roughly parallel to the axis. In the illustrated example, the accessory rail 3 is a Picatinny rail. The distance between the weapon 1 and the rail 3 is less than the distance between the weapon 1 and a carrying handle, when a carrying handle, instead of the rail 3, is connected thereto.

Toward the rear end of the rail 3, there is a rear holder 7 that is slipped onto a rail-like longitudinal formation at the top and rear side of the weapon case and acts like a movable bearing. At the other side, the front end of the rail 3 is fastened by bolts, or any other mechanical fastener, to the top and front side of the weapon case via a front holder 5 that acts like a fixed bearing.

Figure 2A:
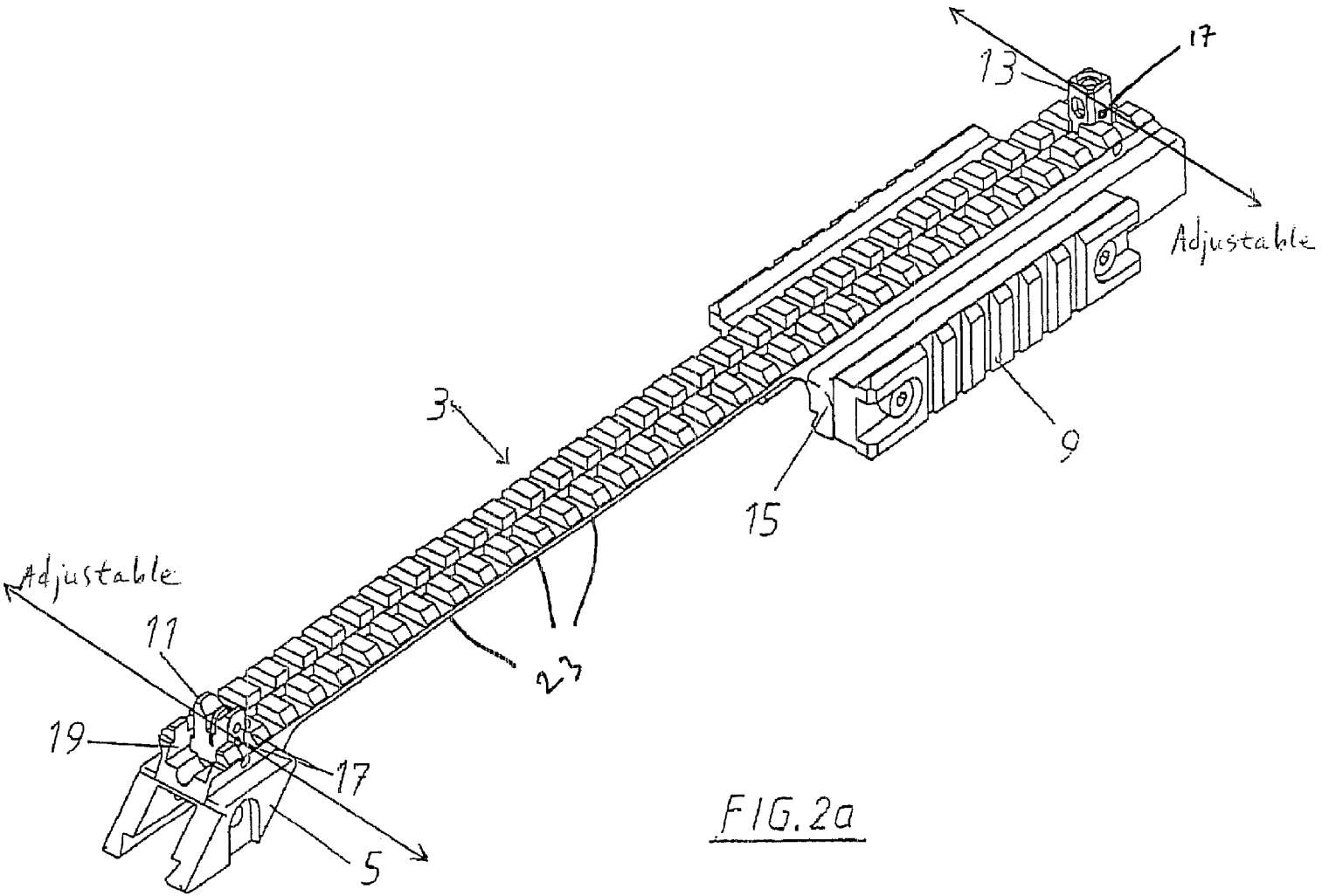
FIG. 2*a* is an oblique view toward the front of the example accessory rail of FIG. 1 including a rear sight and a front sight.
Figure 2B:
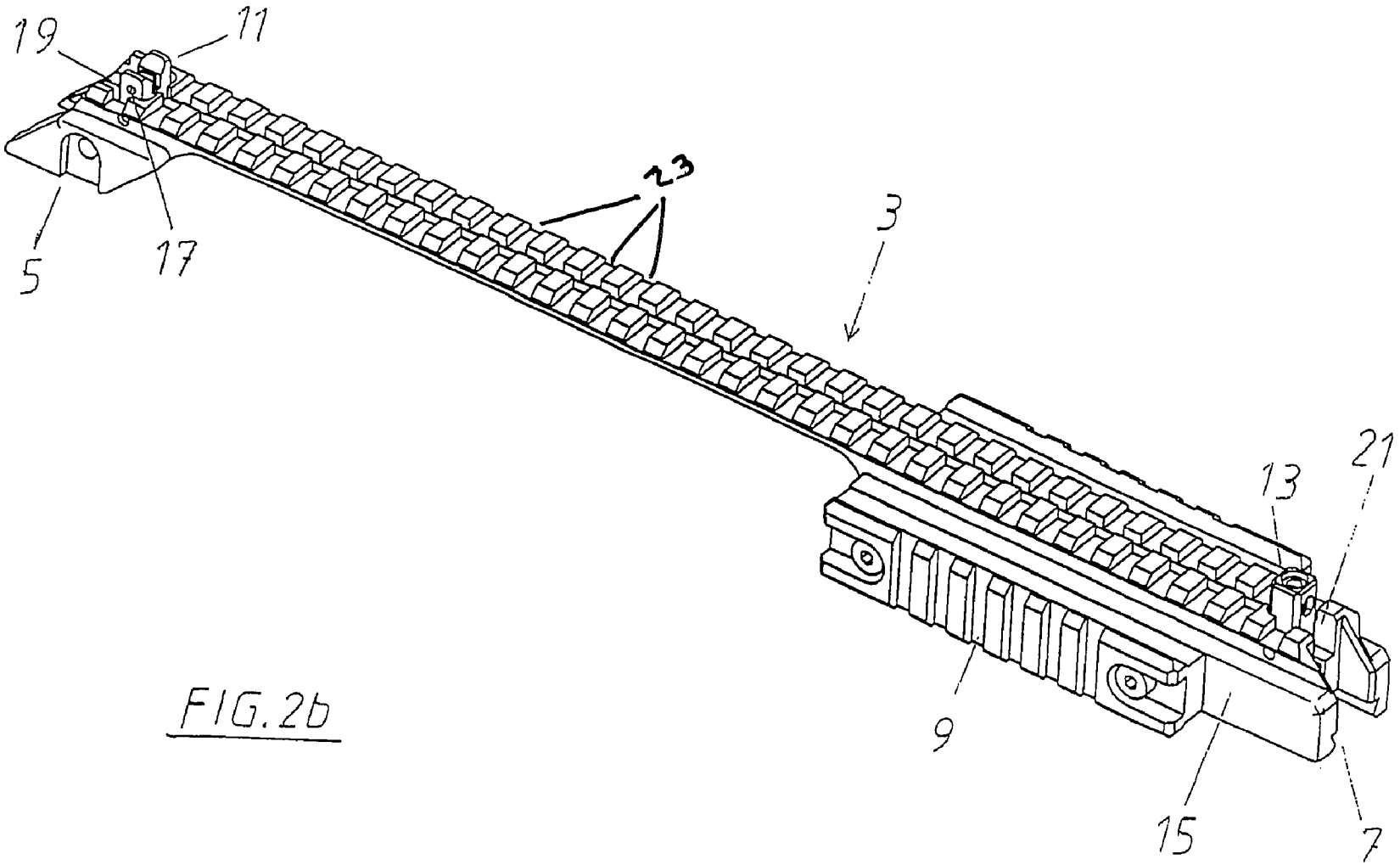
FIG. 2*b* is an oblique view toward the rear of the example accessory rail of FIG. 1 including a rear sight and a front sight.

At the front of the rail 3, there is a front recess 19 that lies transverse to the center of the rail 3 and is open at the top. Likewise, at the rear of the rail 3, there is a rear recess 21 that also lies transverse to the center of the rail 3 is and is open at the top. At the rear side of the front recess 19, a front aiming device or sight 11 is seated that can be folded toward the front. Further, at the front side of the rear recess 21 there is a rear aiming device or sight 13, which can be folded toward the rear (see FIGS. 2*a*, 2*b* and 3). In the illustrated example, the rear sight 13 is a diopter sight, though other types of sights may be used either the front sight 11 or the rear sight 13.

The front sight 11 and the rear sight 13 can be in the unfolded position (FIGS. 2*a*, 2*b*) so that they serve as the standard sight of the automatic pistol 1, or can be folded downward to the front or the back (FIG. 3) so that the rail 3 has essentially an even upper surface that is only interrupted by transverse slots 23. The flatly folded front and rear sights 11, 13 do not project beyond the contour of the rail 3 so that—when both the front sight 11 and diopter sight 13 are folded—an add-on unit such as, any other accessory, can be effortlessly slipped onto the rail 3 from the front or the rear or can be removed from therefrom with similar ease.

As described in greater detail below, the front sight 11 includes a pair of transverse running pins or screws 17 is arranged that are used for lateral adjustment of the front sight 11. The rear sight 13 may include similar structures for lateral adjustment thereof.

Figure 3:
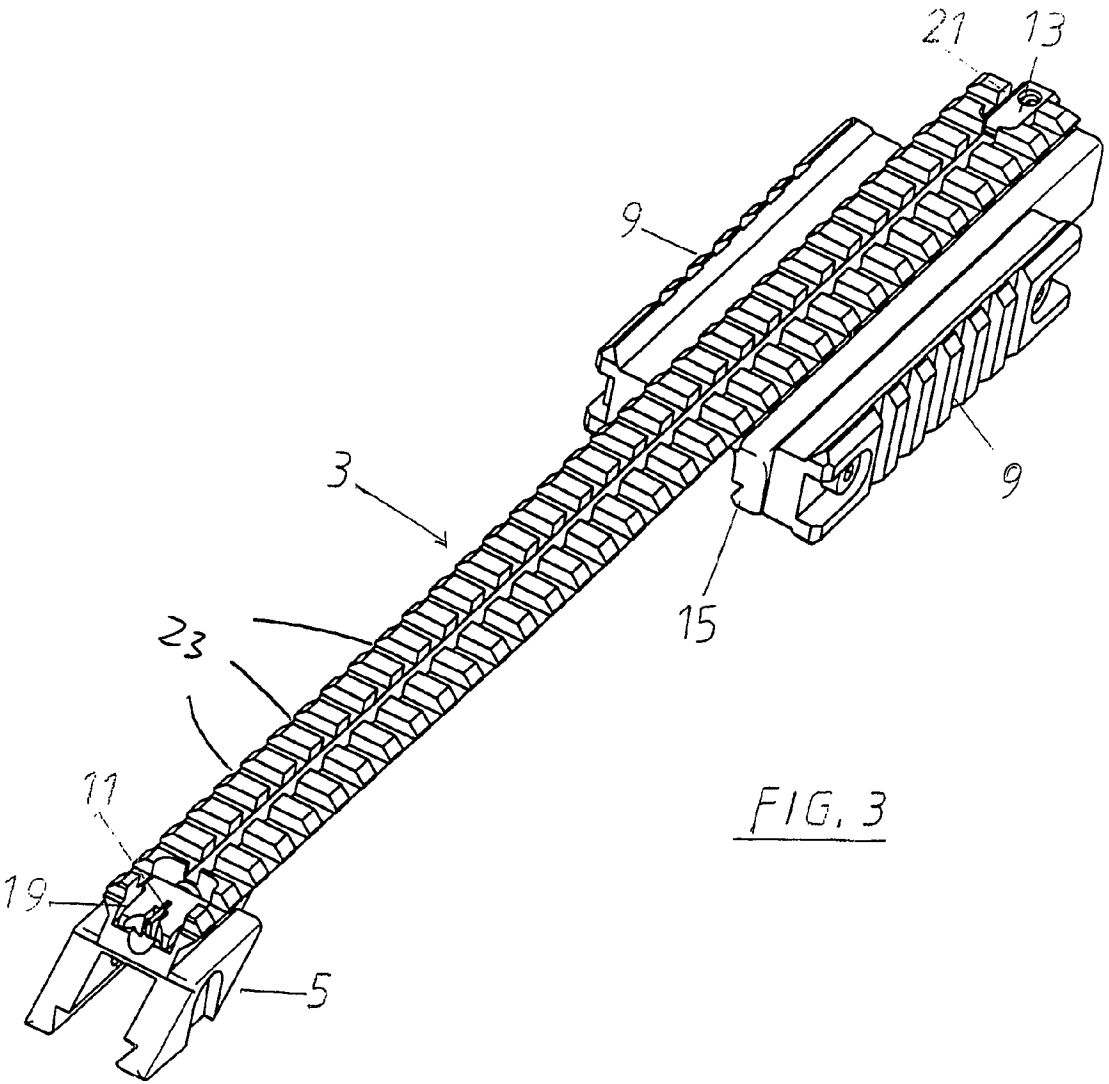
FIG. 3 shows the example accessory rail of FIG. 2*a* with the front and rear sights in the folded position.

The rear side of the rail 3 has a lateral rail assembly 15 on each side at the rear holder 7, to which a lateral rail 9 can be mounted that is similar to the rail 3, but which is shorter, offset and tilted by an angle, such as for example, 90° to the outside of the center axis. As shown in FIG. 3, there may be a lateral rail 9 on either or both sides of the weapon 1. The rail 3 with its holders 5, 7 as well as lateral rail(s) 9 may be made of an aluminum alloy and preferably provided with a coating or anodic treatment to protect these components from external damages including environmental factors such as, for example, ocean air.

As described above, a significant disadvantage of known weapons is the inability to use both standard sights and other accessories such as, for example, special aiming devices. The present disclosure describes a rail with standard devices that can be used with other accessories. The example rail 3, described herein may be used with handguns such as, for example, government issued weapons like automatic pistols. A person of ordinary skill in the art would recognize several advantages of the disclosed illustrated example including the ability to mount additional accessories such as, for example, special aiming devices to the rail 3 without the misalignment of the sights that is experienced with conventional designs. In fact, with the illustrated example retractable sights 11, 13 with lateral screws 17, the line of sight is maintained in the most optimum position possible while accessories are coupled to or decoupled from the rail 3.

As described above, it is possible to mount additional accessories to the rail without sight losses because the front sight arrangement 11 and rear sight 13 can both be lowered into the accessory rail 3. In addition, the entire accessory rail 3, as constructed for the mounting of additional accessories, has a width that exceeds that of the front sight 11 and rear sight 13. When both the front sight 11 and the rear sight 13 are lowered, an accessory can be slipped onto the example accessory rail 3 both from the front as well as from the rear because the lowered sights 11, 13 are preferably flush to the upper surface of the accessory rail 3. In addition, as described above, the width of the accessory rail 3 exceeds that of the sights 11, 13 so that the sights, 11, 13, in the lowered state, do not impair the movement of an accessory on the accessory rail 3.

The actual lowering of front sight 11 and rear sight 13 is best described as being done by a folding action that causes a rotation of the front sight 11 and/or the rear sight 13 about an axis that is horizontal and transverse to the center bore axis.

Though wide rails are known to be constructed in the top casing of very heavy automatic pistol (e.g., the "Desert Eagle" by IMI of Israel), these weapons include standard rigidly connected sights, and, thus, do not allow other accessories to be slidably added or removed onto/from the rail from either the front or the rear. Rather, these known firearms always require additional assemblies for any added accessories that are openably pivotable or otherwise expandable so these accessories can be widened far enough to be placed upon the rail from above. In addition, the marksman's line of vision is hindered when any accessory whose line of sight coincides or collides with that of the standard sight, i.e., the standard sight blocks the line of sight of an additional accessory.

The accessory rail 3 can, as in the case of the aforementioned, known firearms, be integrated into the weapon 1. However, the accessory rail 3 may also be slipped on and removed from the weapon 1 so that the weapon 1 has a modular construction, which enables the use of simple resources to create several designs in a cost-effective production. Moreover, as mentioned above, the front sight 11 and/or rear sight 13 of the accessory rail 3 may be laterally adjusted to customize the standard sight as precisely as possible to each weapon and for each marksman.

Because of the modular construction of the accessory rail 3 and the sights 11, 13, practically the same line of sight can be created repeatedly, and the example accessory rail 3 may, in principle, be used with various types of firearms without restriction. For example, the accessory rail 3 may be used with weapons for snipers, automatic pistols, machine guns and pistols, bazookas, portable grenade launchers for direct or quasi-direct shooting, and many more. However, the interface between the accessory rail 3 and the case of the weapon 1 must be compatible.

As noted above, the example accessory rail 3 is particularly suited for an automatic firearm that includes a handle-like component (not shown) on the top of the weapon 1 that includes a sight. As described herein, the handle-like component may serve as a protective covering, a handle, and a platform or support for the sight, wherein the sighting has a line of sight that lies relatively far above the top of the weapon. With a sight that lies far above the top the weapon 1, the weapon 1 may be designed so that the shoulder support lies about at the height of the axis of the bore (center axis of the barrel), which provides for a more favorable recoil along this axis.

Without a protective cover, some weapons have a sight that can be turned downward (e.g., with the Swiss automatic rifle 57). However, as soon as the parts must be protected from rough contact with the environment, such as for example with the cocking slide of the French automatic rifle FA MAS F3, the marksman couples a protective or carrying strap to the top side of the weapon, which then carries the standard sight above the top of the weapon (as mentioned above). When a sight is located further above the top of a weapon, the sight requires greater fastening so as to be affected less by the backlash or recoil of the weapon. Consequently, it is particularly difficult to mount an additional, backlash-free rail or holder for the accessories that, when needed, permits a special aiming device or sight above the standard sight but also arranges the line of sight of the accessory as anatomically favorable as that of the standard sight. Therefore, a person of ordinary skill in the art would recognize that the illustrated example is beneficial because the example described herein includes a kit made up of an automatic rifle 1 with a detachable carrying strap and an accessory rail 3 for holding accessories that can be built or placed on the rifle 1 in place of the previous carrying strap and, which further has a retractable front sight 11 on its front side and a retractable rear sight 13 on its rear side.

Because the carrying strap must be mounted to resist recoil in transverse direction and vertical direction of the weapon 1, the accessory rail 3 can likewise be similarly mounted to resist recoil. In addition to serving as the protective covering for the movable parts of the weapon 1, the accessory rail 3 also provides a base for mounting other accessories where the line of sight of the additional accessories will not be too high, as occurs with the sight on the carrying handle. This is because the accessory rail 3 runs lower over the weapon 1 than the carrying handle, the sights 11, 13 can be folded downward to allow accessories to pass thereover, and the accessories can be mounted above the accessory rail 3 at precisely the ideal height. In addition, the position of the accessory rail 3 only indirectly influences that of the line of sight of the standard sight.

As mentioned throughout, the illustrated example assembly rail 3, when mounted to the top side of a firearm, may include a variety of other accessories. Because the front and rear sights 11, 13, are retractable, the accessories may be easily and quickly coupled and/or decoupled the accessory rail 3 by, for example, simply sliding the accessory onto the accessory rail 3. When the sights 11, 13 are in the folded or closed state, the accessories can be added and/or removed. When the sights 11, 13 are in the open or unfolded state, the sights 11, 13 are ideally positioned above and vertical to the accessory rail 3. In addition to the retractability of the front and rear sights 11, 13, the accessories are easily attachable to the accessory rail 3 because the cheek pieces of the accessories must only grasp and/or release the accessory rail 3. Contrarily, with traditional designs, the accessories have to be widely expanded so as to clear the accessory rail 3 and be lifted upward for removal from the weapon 1.

Furthermore, the shape of the accessory rail 3 can vary widely. However, the cross-sectional profile should remain the same so as to not hinder the ability of any accessory to be mounted or removed from the accessory rail 3 through the forward or rearward sliding of the accessory over the accessory rail 3 as described above. One example shape is for the accessory rail 3 is that the accessory rail 3 has a downward tapering symmetrical cross-section. That is, the accessory rail 3 is similar to a dovetail. In addition, the upper longitudinal edges of the accessory rail 3 may preferably be beveled so that no sharp corners are formed on which the marksman could injure himself. The accessory rail 3 should also have the transverse slots 23 into which a bolt, cheek piece or other portion of the accessories can grasp. This shape is well-known for example with Picatinny rails. Such a rail is, compared to the dovetail of classical slip-on assemblies, relatively wide and in some circumstances designed of plastic.

Within the framework of the present invention it is, however, preferred that the accessory rail 3 consist of a metal, and in particular, of an aluminum alloy. The metal ensures resistance against surface pressures. In addition, because of the large dimensions of a Picatinny rail, a light metal is completely sufficient to securely carry even heavy devices such as, for example, distance meters that are equipped with electronics for calculation of elevation. Also, because the height of the accessory rail 3 with respect to the weapon 1 is much lower than the carrying handle of traditional designs, even heavier, more durable designs of accessories can be used than could be mounted on the carrying handle.

The retractable sights 11, 13 may be an open sight as is known from hunting rifles and most military rifles of the early 20th century. However, it is preferred that at least one the sights 11, 13 be a diopter sight. While a diopter sight is inferior to an open sight in luminous intensity and immunity to dirt and moisture, a diopter sight has quite significant advantages as far as accommodating the capacity of the eye and the experience of the marksman are concerned. The rear sight 13 is favored for the placement of the diopter sight so that the diopter sight is placed close to the eye of the marksman. Placement of the rear sight 13 close to the marksman's eye enables the length of the accessory rail 3 to be fully exploited for the standard sight. In particular, the accessory rail 3 should be brought as close as possible up to below the eye of the marksman, which would permit optical sights of all types, even small ones.

If the accessory rail 3 is mounted to a handgun, in particular to an automatic pistol, then the accessory rail 3 is fixed in the vertical and the transverse directions. However, the accessory rail 3 has a movable bearing in longitudinal direction that enables the accessory rail 3 to accept tolerances, thermal expansions, etc. of the weapon 1 without generating tensions. Therefore the accessory rail 3 can also have a considerable length compared to usual military slip-on assemblies, which further improves the precision of the position of the sights 11, 13. Consequently, the illustrated example also includes lateral position adjusters 17 that are used to adjust the lateral positions of either or both the front sight 11 or the rear sight 13, which enables the standard sight to be customized as precisely as possible to each weapon.

In an alternative example, the accessory rail 3 for the weapon 1 (e.g., an automatic firearm) may be sold or otherwise kept with the carrying handle for that weapon 1. In such cases, the accessory rail 3 can be removed from the weapon 1 and replaced with the carrying handle and vice versa depending on the marksman's choice and/or situation (e.g., environmental or transportation concerns) without it being necessary to test the respective standard sight again.

Often several accessories are mounted to a weapon, such as an infrared night aiming device and its associated search lights. Formerly it was usually customary to arrange these devices on top of one another, which resulted in considerable overall heights for the equipped weapon. With the illustrated example accessory rail 3, there is at least one second accessory rail 9, which extends parallel to the first or main accessory rail 3. The second accessory rail 9 may be mounted laterally and at an angle such as, for example, an orthogonal. Consequently, accessories may be arranged in collar-like fashion around the weapon 1 and, therefore, cause the weapon to be more compact. By mounting the second accessory rail (s) 9 to the rear side of the first accessory rail 3, several sighting devices may be arranged within the field of vision of the marksman.

Provided that no other devices or components of the weapon 1 are disturbed, it may be possible to work the accessory rail 3 from the top casing of the weapon 1. Alternatively, the accessory rail 3 may be separately manufactured and then placed directly on the weapon 1. No further fastening devices are needed. However, for added security, a front holder 5 and a rear holder 7 are placed at the front end and rear end of the accessory rail 3, respectively. The use of the holders 5, 7, is advantageous because the holders 5, 7 may be designed individually as a fixed bearing or a movable bearing. Consequently, as is analogous for example in the case of a steel bridge, the relative thermal expansions between the weapon 1 and the accessory rail 3 are permitted and accommodated for without having any effect on these or other components.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An accessory rail for use with a firearm, the accessory rail comprising:

a mounting portion having a front section a central section and a rear section wherein the front section central section and rear section have substantially a first width;

a front sight arrangement disposed in the front section of the mounting portion that has a second width, wherein the second width is less than the first width to enable a first accessory to be slipped onto or off of the mounting portion; and a rear sight arrangement disposed in the rear section of the mounting portion that has a third width, wherein the third width is less than the first width to enable at least one of the first accessory or an additional accessory to be slipped onto or off of the mounting portion, wherein at least one of the front sight arrangement and the rear site arrangement is retractable and laterally adjustable.

2. An accessory rail as defined in claim 1, wherein the rail has a downward tapering symmetrical cross-section.

3. An accessory rail as defined in claim 1, further including at least two upper longitudinal edges, wherein the upper longitudinal edges are beveled.

4. An accessory rail as defined in claim 1, wherein the rail is made of a metal.

5. An accessory rail as defined in claim 4, wherein the metal is an aluminum alloy.

6. An accessory rail as defined in claim 1, wherein at least one of the front sight or the rear sight is a diopter sight.

7. An accessory rail as defined in claim 1, wherein the rail further includes a front holder and a rear holder, wherein the front holder and the rear holder mount the rail to the firearm.

8. An accessory rail as defined in claim 1, wherein the front section, the central section and the rear section share a substantially uniform width.

9. A firearm comprising:

a weapon case;

a first accessory rail having a mounting portion with a width, wherein the first accessory rail includes:

a front sight arrangement that has a width less than the width of the mounting portion to enable a first accessory to be slipped onto or off of the mounting portion;

a rear sight arrangement that has a width less than the width of the mounting portion to enable at least one of the first accessory or an additional accessory to be slipped onto or off of the mounting portion; and at least one lateral position adjuster to adjust the lateral position of at least one of the front sight arrangement and the rear site arrangement, wherein the lateral position adjuster does not extend past the width of the mounting portion.

10. A firearm as defined in claim 9, wherein the first accessory rail has a downward tapering symmetrical cross-section.

11. A firearm as defined in claim 9, wherein the first accessory rail further includes at least two upper longitudinal edges, wherein the upper longitudinal edges are beveled.

12. A firearm as defined in claim 9, wherein the first accessory rail is made of a metal.

13. A firearm as defined in claim 12, wherein the metal is an aluminum alloy.

14. A firearm as defined in claim 9, wherein at least one of the front sight or the rear sight is a diopter sight.

15. A firearm as defined in claim 9, wherein the first accessory rail further includes a front holder and a rear holder, wherein the front holder and the rear holder mount the rail to the firearm.

16. A firearm as defined in claim 9 further including a second accessory rail that extends parallel to the first accessory rail and is mounted laterally and at an angle.

17. A firearm as defined in claim 16, wherein the angle is an orthogonal.

18. An accessory rail as defined in claim 1, wherein both of the front sight arrangement and the rear site arrangement are retractable and laterally adjustable.

19. A firearm as defined in claim 9, wherein both of the front sight arrangement and the rear site arrangement are retractable and laterally adjustable.

* * * * *